US009329522B2

(12) United States Patent
Itabashi

(10) Patent No.: US 9,329,522 B2
(45) Date of Patent: May 3, 2016

(54) DEVELOPING CARTRIDGES WITH FIXED PROTRUSIONS AND MANUFACTURING METHOD THEREOF

(71) Applicant: Nao Itabashi, Nagoya (JP)

(72) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/626,418

(22) Filed: Feb. 19, 2015

(65) Prior Publication Data

US 2015/0160584 A1 Jun. 11, 2015

Related U.S. Application Data

(63) Continuation of application No. 14/032,278, filed on Sep. 20, 2013, now Pat. No. 8,995,891.

(30) Foreign Application Priority Data

Sep. 21, 2012 (JP) ..... 2012-208909

(51) Int. Cl.
*G03G 15/08* (2006.01)
*G03G 21/18* (2006.01)

(52) U.S. Cl.
CPC ..... *G03G 15/0812* (2013.01); *G03G 15/0865* (2013.01); *G03G 21/1821* (2013.01)

(58) Field of Classification Search
CPC ..... G03G 15/0812; G03G 21/1839; G03G 21/1821
See application file for complete search history.

(56) References Cited

U.S. PATENT DOCUMENTS 5,470,635 A 11/1995 Shirai et al.
5,608,509 A 3/1997 Shirai et al.
5,966,568 A * 10/1999 Numagami ..... G03G 21/1825 222/DIG. 1
6,070,028 A * 5/2000 Odagawa ..... G03G 21/1832 399/104

(Continued)

FOREIGN PATENT DOCUMENTS

JP 2011-150268 A 8/2011

OTHER PUBLICATIONS

State Intellectual Property Office of the People's Republic of China, Notification of First Office Action issued for Chinese Patent Application No. 201310425716.1 (foreign counterpart of parent of above-captioned patent application), mailed Dec. 1, 2015.

*Primary Examiner* — David Bolduc
(74) *Attorney, Agent, or Firm* — Baker Botts L.L.P.

(57) ABSTRACT

Developing cartridges include a main body, a developer transport member, and a developer thickness regulating member. The main body includes a first and second side portions separated from each other along a direction. The developer thickness regulating member regulates a developer thickness and extends in a direction between the first and second side portions. The developer thickness regulating member includes an end portion, which is disposed near the first side portion, and a first protrusion, which extends along the particular direction from the end portion to at least the first side portion. The main body forms a cavity in the first side portion. The cavity is defined by at least a first surface, a second surface opposing the first surface, and a second protrusion that protrudes from the first surface toward the second surface. The first protrusion is fixed at a position between the second protrusion and the second surface.

24 Claims, 13 Drawing Sheets

(56) References Cited

U.S. PATENT DOCUMENTS

| | | | | |
|---|---|---|---|---|
| 6,088,564 | A | 7/2000 | Imes et al. | |
| 6,115,565 | A | 9/2000 | Noda | |
| 6,137,970 | A * | 10/2000 | Sasago | G03G 21/1832 399/106 |
| 6,137,973 | A * | 10/2000 | Nishiuwatoko | G03G 21/181 399/111 |
| 6,173,145 | B1 * | 1/2001 | Chadani | G03G 15/0935 399/265 |
| 6,212,343 | B1 | 4/2001 | Hosokawa et al. | |
| 6,442,359 | B1 * | 8/2002 | Numagami | G03G 21/1821 399/111 |
| 6,571,070 | B2 | 5/2003 | Oguma et al. | |
| 7,532,840 | B2 | 5/2009 | Nishimura et al. | |
| 8,929,795 | B2 * | 1/2015 | Inami | G03G 21/0029 399/351 |
| 2001/0021329 | A1 | 9/2001 | Nittani et al. | |
| 2001/0026707 | A1 | 10/2001 | Miyabe et al. | |
| 2003/0228171 | A1 | 12/2003 | Miyabe et al. | |
| 2004/0120734 | A1 | 6/2004 | Okamoto | |
| 2005/0220501 | A1 | 10/2005 | Toba et al. | |
| 2005/0254862 | A1 | 11/2005 | Toba et al. | |
| 2006/0024085 | A1 | 2/2006 | Sato et al. | |
| 2008/0260426 | A1 | 10/2008 | Tanaka et al. | |
| 2009/0110434 | A1 | 4/2009 | Kusudo et al. | |
| 2011/0158709 | A1 | 6/2011 | Mori | |
| 2011/0255898 | A1 | 10/2011 | Kashiide et al. | |
| 2013/0164029 | A1 * | 6/2013 | Fukui | G03G 21/1647 399/111 |

* cited by examiner

DEVELOPING CARTRIDGES WITH FIXED PROTRUSIONS AND MANUFACTURING METHOD THEREOF

CROSS-REFERENCE TO RELATED APPLICATION

This application is a continuation of U.S. patent application Ser. No. 14/032,278 filed on Sep. 20, 2013, which claims priority from Japanese Patent Application No. 2012-208909 filed on Sep. 21, 2012, the disclosures of which are incorporated herein by reference.

BACKGROUND OF THE DISCLOSURE

1. Field of the Disclosure

The present disclosure relates generally to developing cartridges and, more specifically, to developing cartridges with fixed protrusions.

2. Description of the Related Art

Image forming devices, such as printers including an image carrier and a developing cartridge configured to supply developer to the image carrier, are known. The developing cartridge provided in such printers includes a developing frame configured to contain developer, a developing roller that is rotatably supported by the developing frame and configured to support developer, and a layer thickness regulating member that is supported on the surface of the developing roller and configured to regulate the layer thickness of developer. In such developing cartridges, the layer thickness regulating member is positioned on the developing frame by screwing both ends of the layer thickness regulating member to the developing frame.

Nevertheless, in the known developing cartridge, a boss provided on the side walls of the developing frame is inserted into installation holes formed in both ends of the layer thickness regulating member, and the screws are secured into the holes of the boss, so as to position the layer thickness regulating member on the developing frame. Consequently, it is necessary to form relatively large installation holes on both ends of the known layer thickness regulating member to accommodate the insertion of the boss, which is formed with a diameter greater than that of each of the screws.

SUMMARY OF THE DISCLOSURE

In view of the above-described size constraints associated with the boss, the screws, and the layer thickness regulating member in the known developing cartridge, it may be difficult to decrease the size of the layer thickness regulating member in a direction perpendicular to an axis of the screw. Accordingly, it may be an object of the present invention to provide a developing cartridge that can be made smaller.

A developing cartridge disclosed herein may include a main body, a developer transport member, and a developer thickness regulating member. The main body may include a first side portion and a second side portion separated from the first side portion along a first direction. The developer transport member may rotate about a rotational axis extending in the first direction and may transport developer. The developer thickness regulating member may regulate a thickness of the developer transported by the developer transport member. Further, the developer thickness regulating member may extend in the first direction between the first side portion of the main body and the second side portion of the main body. Moreover, the developer thickness regulating member may include a first end portion, a second end portion, and a first protrusion. The first end portion may be disposed near the first side portion of the main body. The second end portion may be disposed near the second side portion of the main body. Further, the second end portion may be opposite to the first end portion along the first direction. The first protrusion may extend along the first direction from the first end portion of the developer thickness regulating member to at least the first side portion of the main body. The main body may form a cavity in the first side portion of the main body. The cavity may be defined by at least a lower surface, an upper surface, and a second protrusion. The upper surface may oppose the lower surface and may be disposed a first distance from the lower surface. The second protrusion may protrude from the lower surface of the cavity toward the upper surface of the cavity. The first protrusion may be fixed at a position between the second protrusion and the upper surface of the cavity.

A method for manufacturing a developing cartridge disclosed herein may include certain processes. The developing cartridge may include a main body, a developer transport member, and a developer thickness regulating member. The main body may include a first side portion and a second side portion separated from the first side portion along a first direction. The developer transport member may rotate about a rotational axis extending in the first direction and may transport developer. The developer thickness regulating member may regulate a thickness of the developer transported by the developer transport member. Further, the developer thickness regulating member may extend in the first direction between the first side portion of the main body and the second side portion of the main body. Moreover, the developer thickness regulating member may include a first end portion, a second end portion, and a first protrusion. The first end portion may be disposed near the first side portion of the main body. The first protrusion may extend along the first direction from the first end portion of the developer thickness regulating member to at least the first side portion of the main body. The main body may form a cavity in the first side portion of the main body. The cavity may be defined by at least a lower surface, an upper surface, and a second protrusion. The upper surface may oppose the lower surface and may be disposed a first distance from the lower surface. The second protrusion may protrude from the lower surface of the cavity toward the upper surface of the cavity. The method processes may include inserting the first protrusion of the developer thickness regulating member into the cavity. Further, the method processes may include moving the first protrusion of the a developer thickness regulating member toward a portion of the cavity formed between the upper surface of the cavity and the second protrusion. Accordingly, the first protrusion of the developer thickness regulating member may deform the second protrusion and may become fixed between the upper surface of the cavity and the second protrusion.

A developing cartridge disclosed herein may include a main body, a developer transport member, and a developer thickness regulating member. The main body may include a first side portion and a second side portion separated from the first side portion along a first direction. The developer transport member may rotate about a rotational axis extending in the first direction and may transport developer. The developer thickness regulating member may regulate a thickness of the developer transported by the developer transport member. Further, the developer thickness regulating member may extend in the first direction between the first side portion of the main body and the second side portion of the main body. Moreover, the developer thickness regulating member may include a first end portion, a second end portion, and a first protrusion. The first end portion may be disposed near the first side portion of the main body. The first protrusion may extend along the first direction from the first end portion of the developer thickness regulating member to at least the first side portion of the main body. The main body may form a cavity in the first side portion of the main body. The cavity may be defined by at least a lower surface, an upper surface, and a second protrusion. The upper surface may oppose the lower surface and may be disposed a first distance from the lower surface. The second protrusion may protrude from the lower surface of the cavity toward the upper surface of the cavity. The developing cartridge may be assembled by performing certain processes. The processes may include inserting the first protrusion of the developer thickness regulating member into the cavity. Further, the processes may include moving the first protrusion of the developer thickness regulating member toward a portion of the cavity formed between the upper surface of the cavity and the second protrusion. Accordingly, the first protrusion of the developer thickness regulating member may deform the second protrusion and may become fixed between the upper surface of the cavity and the second protrusion.

A developing cartridge disclosed herein may include a main body, a developer transport member, and a developer thickness regulating member. The main body may include a first portion and a second portion separated from the first portion along a particular direction. The developer transport member may rotate about a rotational axis extending in the particular direction and may transport developer. The developer thickness regulating member may regulate a thickness of the developer transported by the developer transport member. Further, the developer thickness regulating member may extend in the particular direction between the first portion of the main body and the second portion of the main body. Moreover, the developer thickness regulating member may include an end portion and a first protrusion. The end portion may be disposed near the first portion of the main body. The first protrusion may extend along the particular direction from the end portion of the developer thickness regulating member to at least the first portion of the main body. The main body may form a cavity in the first portion of the main body. The cavity may be defined by at least a first surface, a second surface, and a second protrusion. The second surface may oppose the first surface and may be disposed a particular distance from the first surface. The second protrusion may protrude from the first surface of the cavity toward the second surface of the cavity. The first protrusion may be fixed at a position between the second protrusion and the second surface of the cavity.

Other objects, features, and advantages will be apparent to persons of ordinary skill in the art from the following detailed description of the disclosure and the accompanying drawings.

BRIEF DESCRIPTION OF THE DRAWINGS

For a more complete understanding of the present disclosure, needs satisfied thereby, and the objects, features, and advantages thereof, reference now is made to the following descriptions taken in connection with the accompanying drawings.

FIG. 4A shows a perspective view of the right portion of the developing frame from an upper-left side thereof; FIG. 4B shows a perspective view of the right portion of the developing frame from a lower-right side thereof; and FIG. 4C shows a perspective view of the left portion of the developing frame from a lower-left side thereof.

FIG. 5A shows a perspective view of the layer thickness regulating blade from an upper-right side thereof; FIG. 5B shows a perspective view of the layer thickness regulating blade from a lower-right side thereof; FIG. 5C shows a perspective view of the right portion of the layer thickness regulating blade from an upper-right side thereof; and FIG. 5D shows a perspective view of the left portion of the layer thickness regulating blade from an upper-left side thereof.

FIG. 7A shows a perspective view of the developing frame and the layer thickness regulating blade from a lower-left side thereof; and FIG. 7B shows a planar view of the right portion of the developing frame and the layer thickness regulating blade.

FIG. 8A shows a perspective view of the developing frame and the layer thickness regulating blade from the upper-right side; and FIG. 8B shows a right side view of the developing frame and the layer thickness regulating blade.

FIG. 9A shows a right side view in which the layer thickness regulating blade is being pushed into the developing frame; FIG. 9B shows a right side view in which pushing the layer thickness regulating blade into the developing frame has been completed; and FIG. 9C shows a planar view of the right portion of the developing frame and the layer thickness regulating blade.

DETAILED DESCRIPTION OF EMBODIMENTS OF THE INVENTION

Figure 1:
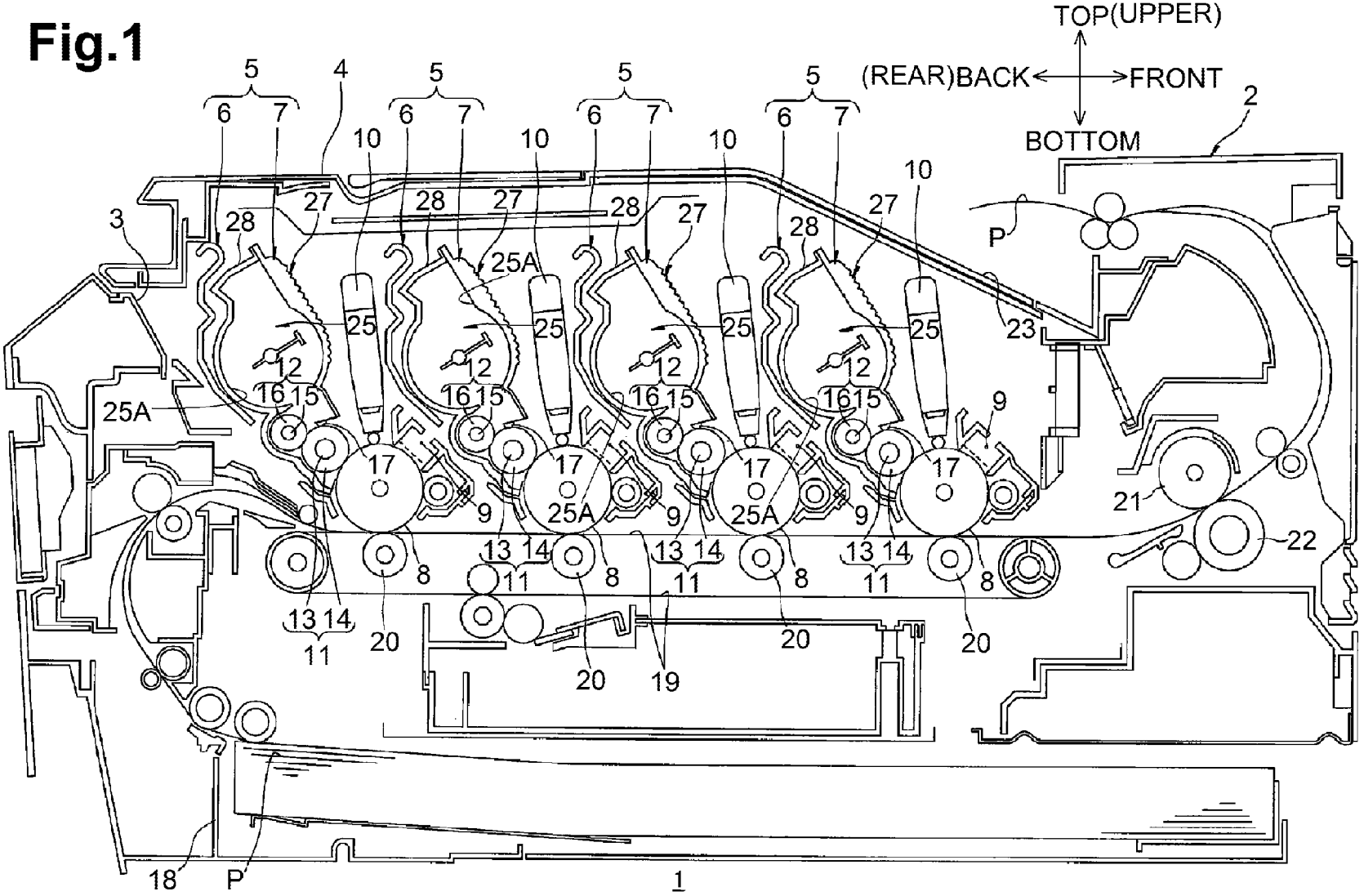
FIG. 1 is a diagram showing a sectional side view of a printer.

As shown in FIG. 1, a printer 1 may be a horizontal direct tandem type of color printer. Further, the directions associated with the printer 1, as used herein, refer to a vertical reference at a state in which the printer 1 lies horizontally, as shown in FIG. 1. Thus, the upper side of the plane of paper in FIG. 1 corresponds to the upper side, the lower side of the plane of paper in FIG. 1 corresponds to the lower side, the left side of the plane of paper in FIG. 1 corresponds to the front side, and the right side of the plane of paper in FIG. 1 corresponds to the back side. Moreover, the horizontal reference refers to a view of the printer 1 from the front side. Thus, the near side of the plane of paper in FIG. 1 may be the right side, and the far side of the plane of paper in FIG. 1 may be the left side.

The printer 1 may comprise a casing 2 that may form a substantially box-shaped shape. The casing 2 may form an opening 3. The printer 1 may comprise a cover 4 that may be pivotally supported at an upper end portion of the casing 2. The cover 4 may be configured to open and close the opening 3 of the casing 2. The printer 1 may comprise a plurality (e.g., four) of process cartridges 5.

Each of the process cartridges 5 may be detachably mounted in the casing 2 in a parallel arrangement and separated from each other. Moreover, each of the plurality of (e.g., four) process cartridges 5 may correspond to one color of a plurality of (e.g., four) colors (e.g., black, yellow, magenta, and cyan). The process cartridges 5 may comprise a drum cartridge 6 and a developing cartridge 7, which may be detachably mounted to the drum cartridge 6.

The drum cartridge 6 may comprise a photosensitive drum 8 and a scorotron charger 9. The photosensitive drum 8 may form a substantially cylindrical shape that may extend in the horizontal direction and may be configured to rotate. The scorotron charger 9 may be disposed at the upper-rear side of the photosensitive drum 8 and may faces the photosensitive drum 8.

The developing cartridge 7 may comprise a developing frame 27 (e.g., a casing), a developing roller 11 (e.g., a developer carrier), and a supply roller 12 configured to supply toner to the developing roller 11. The developing roller 11 may comprise a developing roller shaft 13, which may extend horizontally, and a rubber roller 14, which may cover the developing roller shaft 13.

The developing roller shaft 13 may form a substantially cylindrical shape, which may extend horizontally. The rubber roller 14 may cover the developing roller shaft 13, such that both ends of the developing roller shaft 13 may be exposed. Further, both ends of the developing roller shaft 13 may be supported by a bearing member. The developing roller 11 may be disposed at an upper-front side of the photosensitive drum 8 and may contact the photosensitive drum 8.

The supply roller 12 may comprise a supply roller shaft 15, which may extend horizontally, and a sponge roller 16, which may cover the supply roller shaft 15. The supply roller shaft 15 may form a substantially cylindrical shape that may extend horizontally. The sponge roller 16 may cover the supply roller shaft 15, such that both horizontal ends of the supply roller shaft 15 may be exposed. Both ends of the supply roller shaft 15 may be supported between side walls 35 (described below) of the developing frame 27. The supply roller 12 may be substantially disposed at the upper side of the developing roller 11 and may contact the developing roller 11.

Further, the developing cartridge 7 may comprise a layer thickness regulating blade 17 (e.g., a layer thickness regulating member) that may regulate the thickness of the toner supplied on the developing roller 11. Moreover, the developing cartridge 7 may comprise a toner storage chamber 25, which may be disposed on the upper side of the developing roller 11 and the supply roller 12, to store toner (e.g., a developer). The toner storage chamber 25 may define the accommodation space 25A for accommodating toner therein.

Further, a positive charge between the supply roller 12 and the developing roller 11 may charge the toner in the toner storage chamber 25. The surface of the developing roller 11 may support the toner as a thin layer of an even thickness in association with the operation of the layer thickness regulating blade 17.

In contrast, the scorotron charger 9 may uniformly charge the surface of the photosensitive drum 8, which may be exposed by a light-emitting diode ("LED") unit 10 in accordance with the predetermined image data. The LED unit 10 may be disposed at upper side of the photosensitive drum 8 and may face the photosensitive drum 8. Consequently, an electrostatic latent image may be formed on the surface of the photosensitive drum 8 in accordance with the image data. Further, the toner supported on the developing roller 11 may be supplied onto the electrostatic latent image on the surface of the photosensitive drum 8, and the toner image (e.g., a developer image) may be supported on the surface of the photosensitive drum 8.

A paper feed tray 18 that may be provided on the bottom portion of the casing 2 may be configured to store paper P, which may be transported by each roller toward the upper-rear side in a U-turn type of pattern and thereafter may be fed between the photosensitive drum 8 and a transport belt 19, one sheet at a time and at a predetermined timing. Further, the paper P may be transported by the transport belt 19 between photosensitive drums 8 and transfer rollers 20 from the front side to the rear side. During this transport process, the toner image may be transferred to the paper P. Moreover, the paper P may be heated and pressurized when passing between a heating roller 21 and a pressurizing roller 22. During this heating process, the toner image may be heat fused to the paper P. Thereafter, the paper P may be transported to the upper-front side in a U-turn type of pattern and discharged to a discharge tray 23, which may be provided at the top cover 4.

Figure 2:
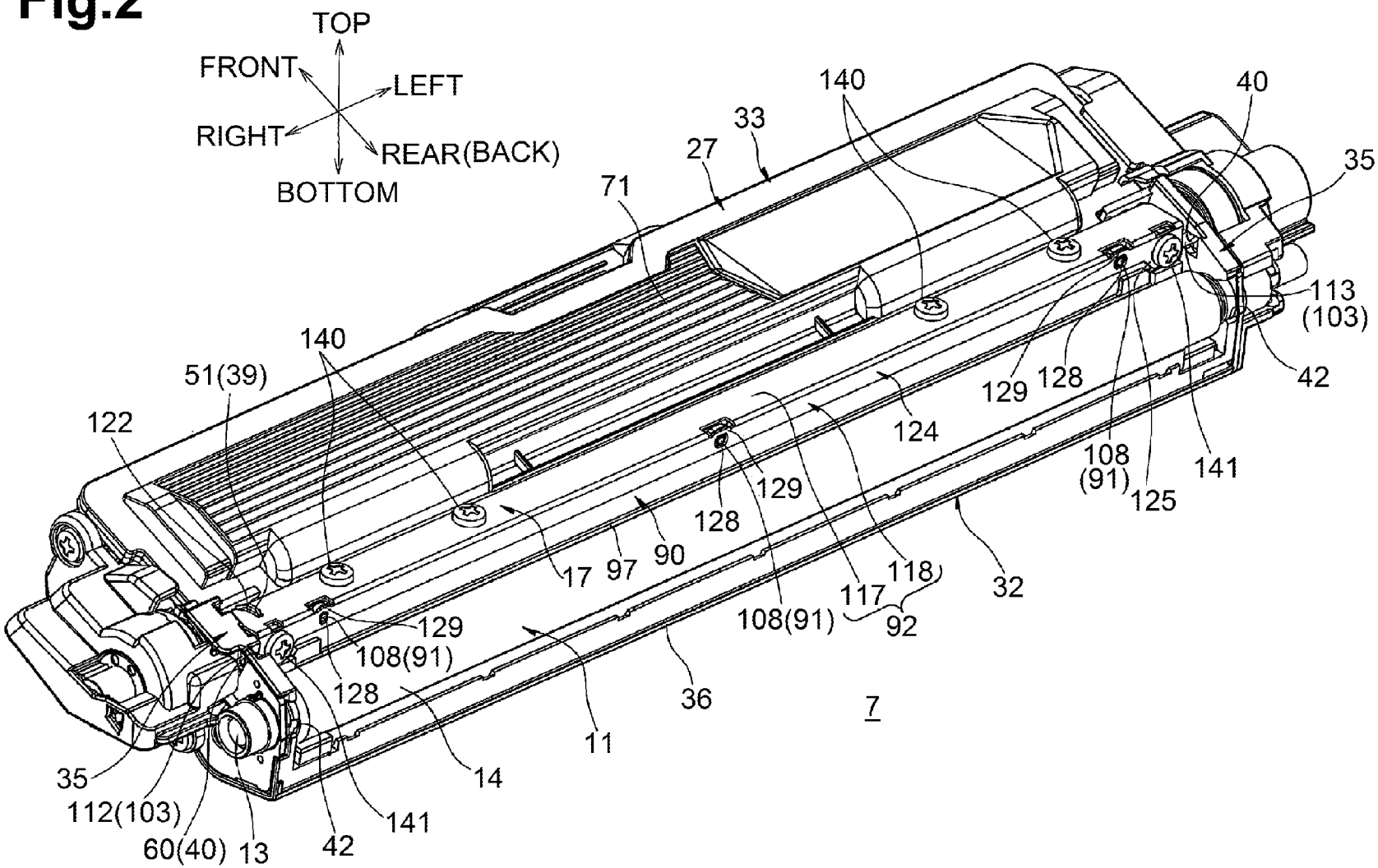
FIG. 2 is a diagram showing a perspective view of the developing cartridge shown in FIG. 1 from an upper-right side thereof.

As shown in FIG. 2 and described above, the developing cartridge 7 may comprise the developing frame 27.

Further the directions associated with the developing cartridge 7, as used herein, refer to the side in which the developing roller 11 may be arranged as the rear side, the side opposite to the rear side as the front side, the side in which the layer thickness regulating blade 17 is arranged as the upper side, and the side opposite to the upper side as the lower side. Thus, in certain circumstances, the front side, rear side, upper side, and lower side of the developing cartridge 7 may be different from the front side, rear side, upper side, and lower side of the printer 1, as used herein.

Figure 3:
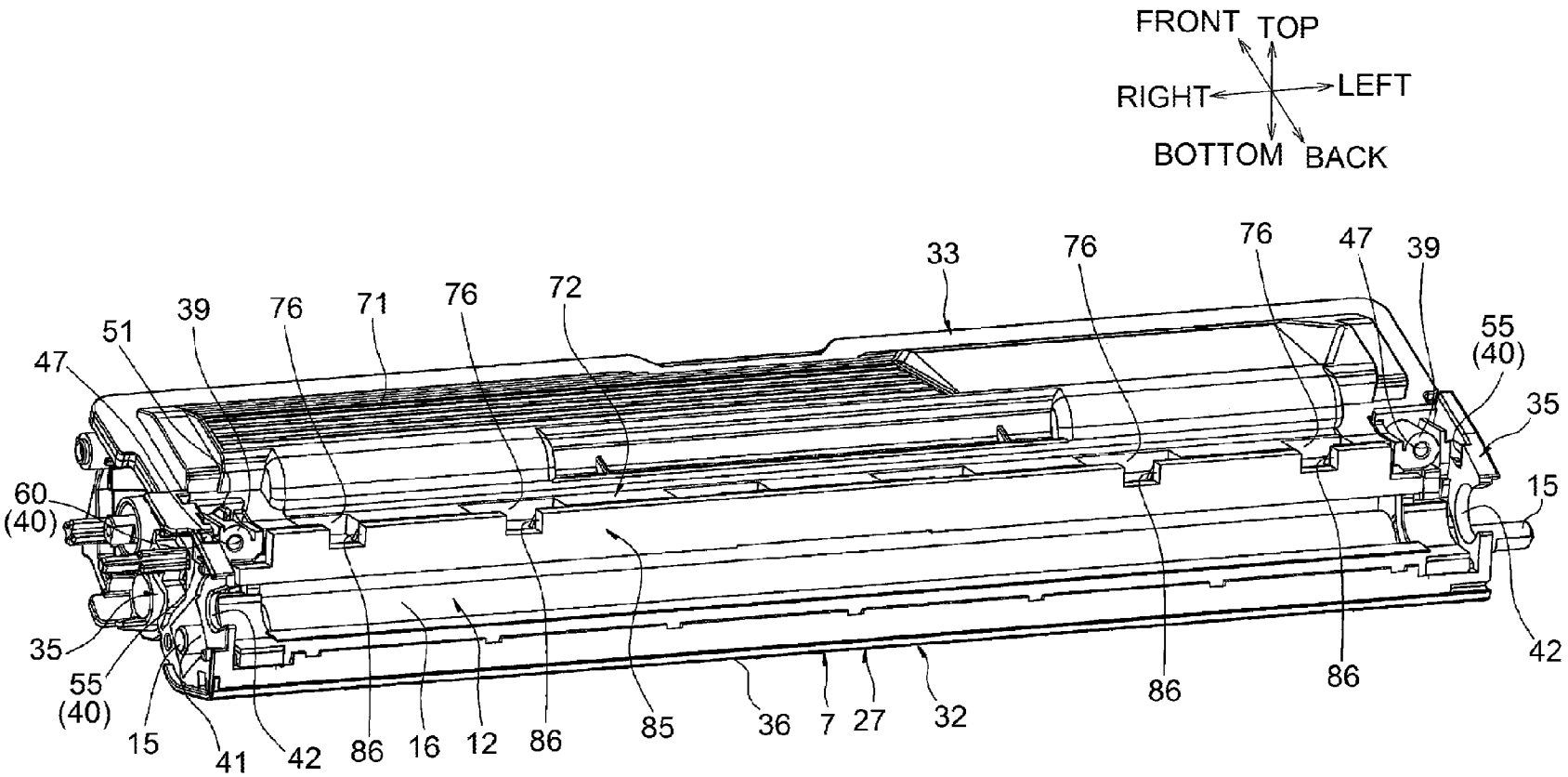
FIG. 3 is a diagram showing a perspective view of the developing frame illustrated in FIG. 2 from an upper-right side thereof.

As shown in FIG. 3, the developing frame 27 may extend horizontally, may form a substantially box-shaped shape opening toward the upper-rear side, and may comprise a lower frame 32 and an upper frame 33 that may combine with the lower frame 32. The lower frame 32 may comprise a pair of side walls 35, a lower wall 36, and a front wall 37 (shown in FIGS. 8A and 8B).

The pair of side walls 35 may form a substantially rectangular plate-shaped shape in the side view, may face each other, and may be separated from each other in the horizontal direction. Moreover, the side wall 35 may form a groove 42, a hole 41, a blade fitting portion 40, and a screwing portion 39.

The groove 42 may form a substantially open-box-shaped shape from the side view opening toward the upper-rear side of the rear end of the side wall 35. The length of the groove 42 in the vertical direction may be greater than the diameter of certain end portions of the developing roller shaft 13 of the developing roller 11. Further, the end portions of the developing roller shaft 13 may be exposed from a side wall 35 toward the outside via the groove 42 (shown in FIG. 2).

The hole 41 may be a through-hole forming a substantially rectangular shape and may be formed at lower-front side of the groove 42 in the side wall 35. The internal dimension of the hole 41 may be greater than the diameter of the end portions of the supply roller shaft 15 of the supply roller 12. Further, the end portions of the supply roller shaft 15 may be exposed from the side wall 35 toward outside via the hole 41.

Figure 4A:
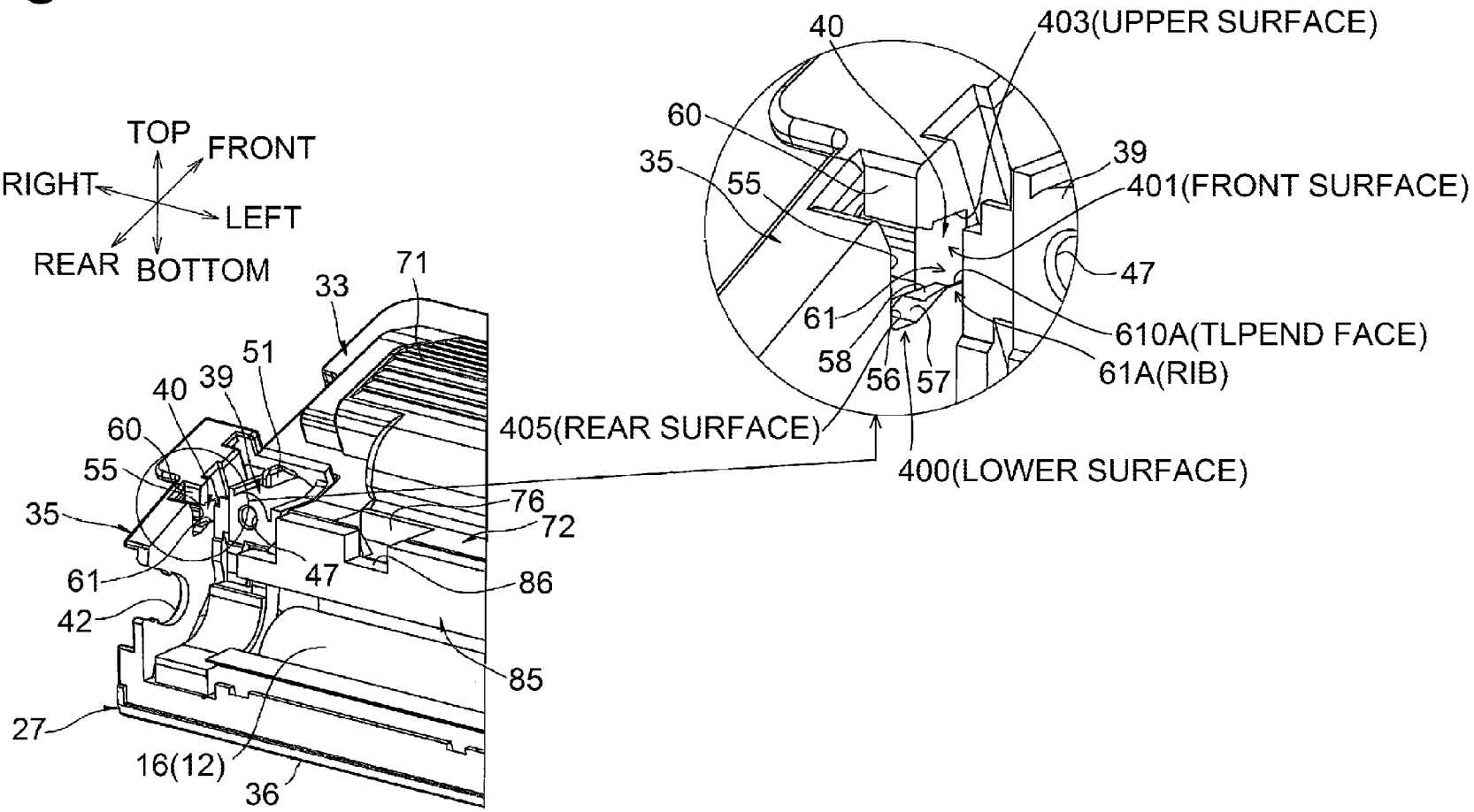
FIGS. 4A through 4C are diagrams showing the developing frame shown in FIG. 3.
Figure 4B:
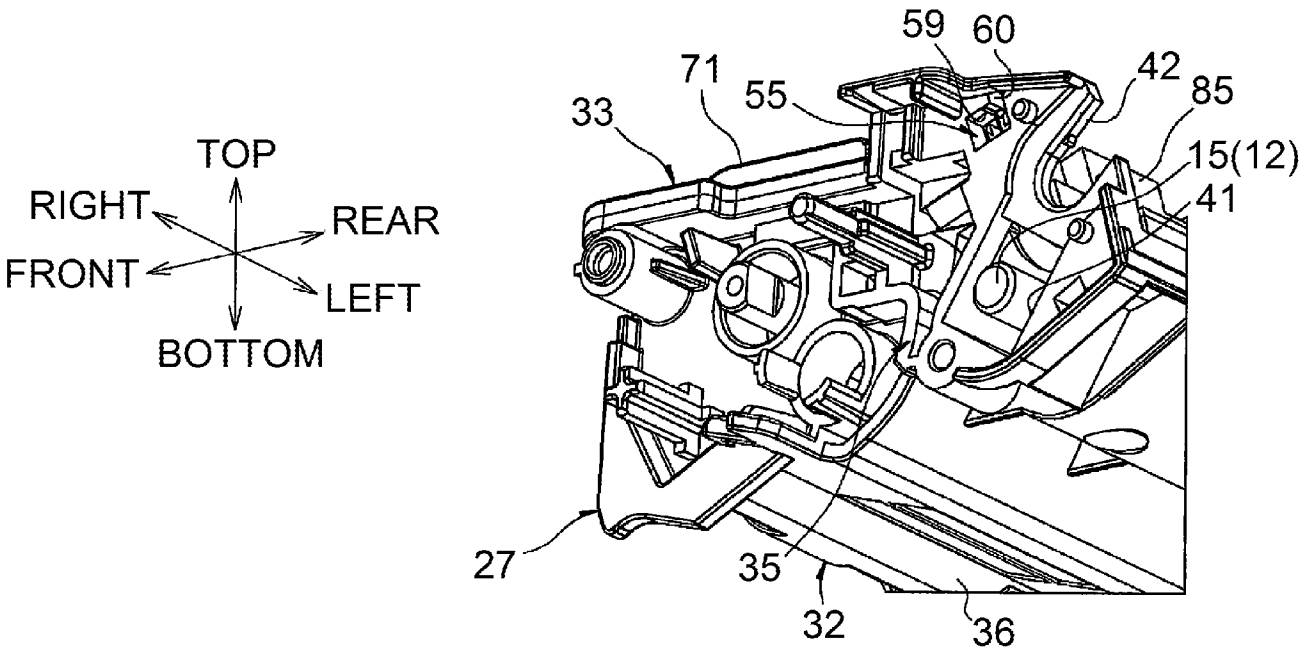
Figure 4C:
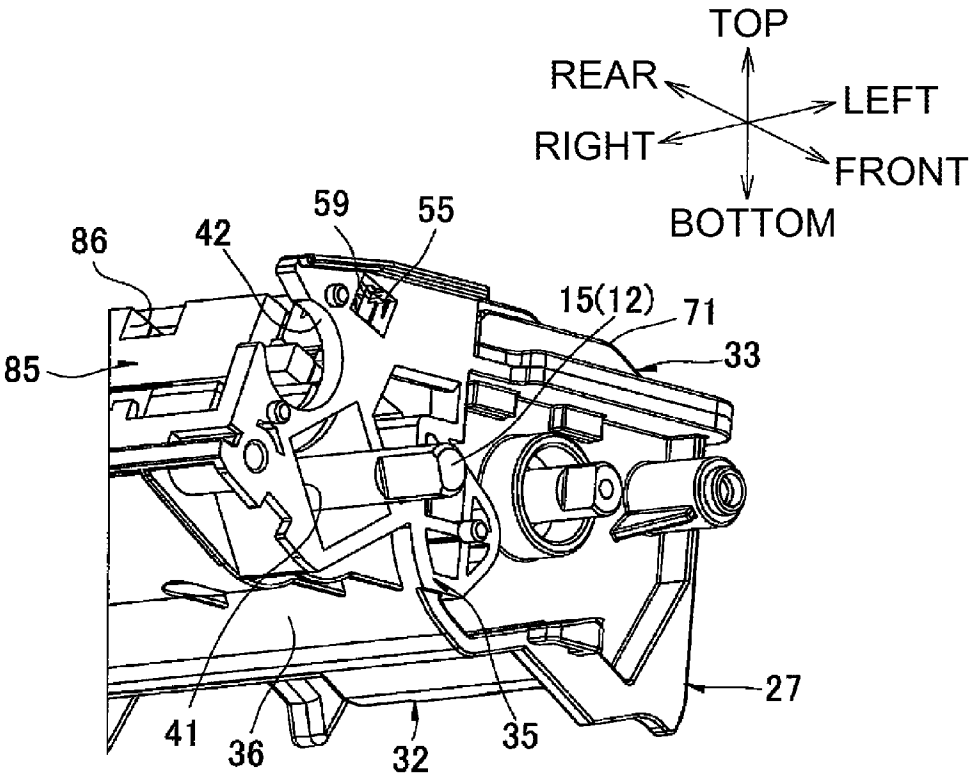
Figure 5A:
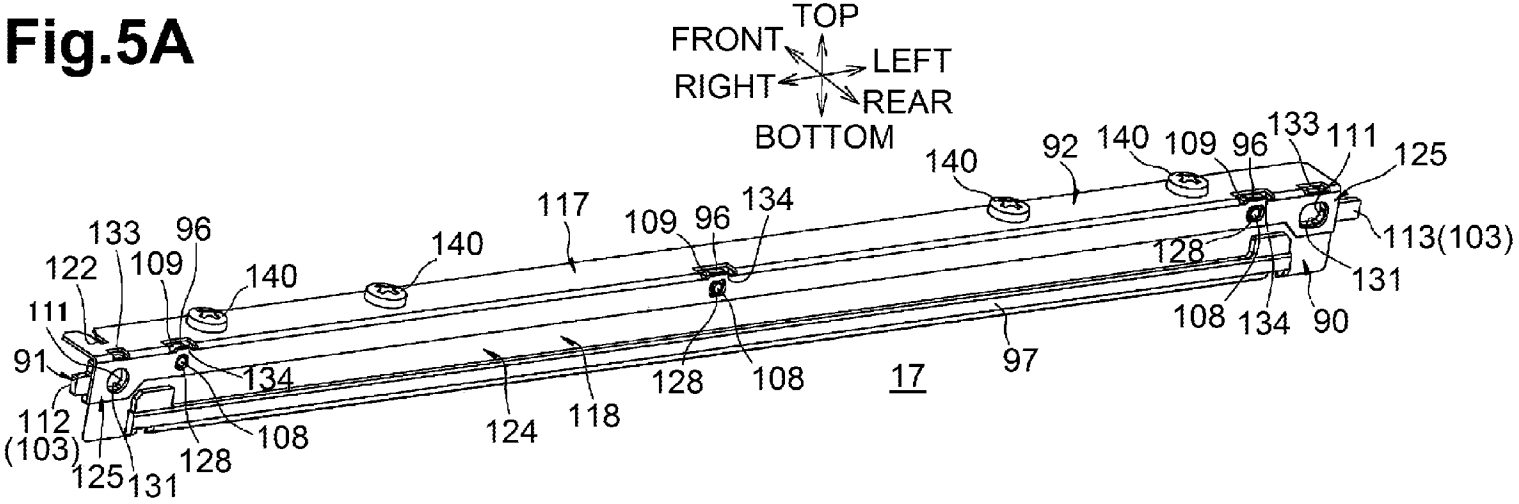
FIGS. 5A through 5D are diagrams showing the layer thickness regulating blade shown in FIG. 2.
Figure 5B:
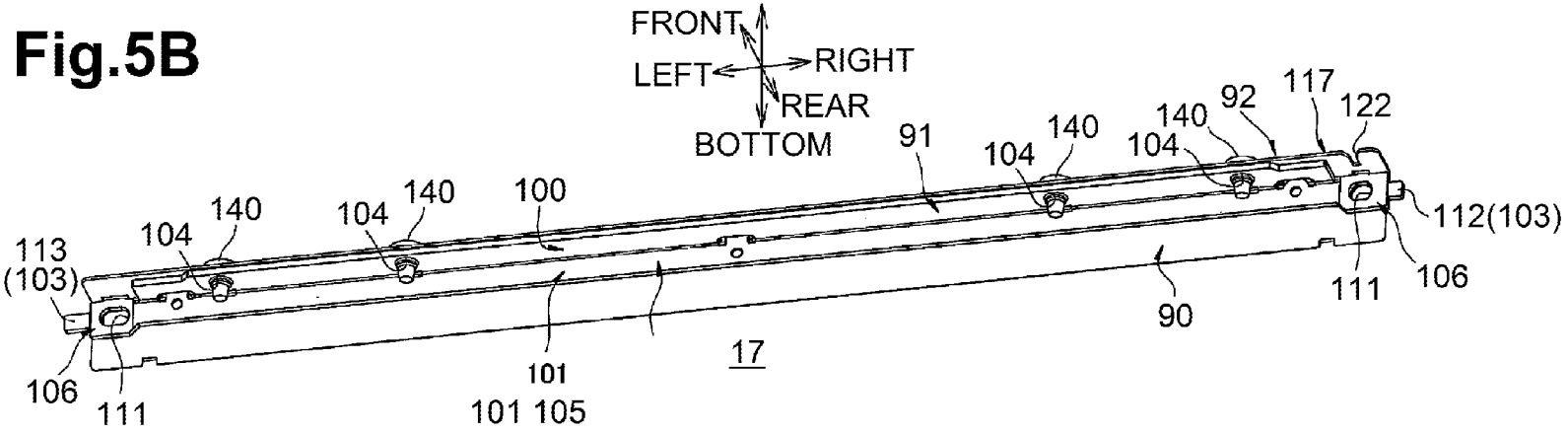
Figure 5D:
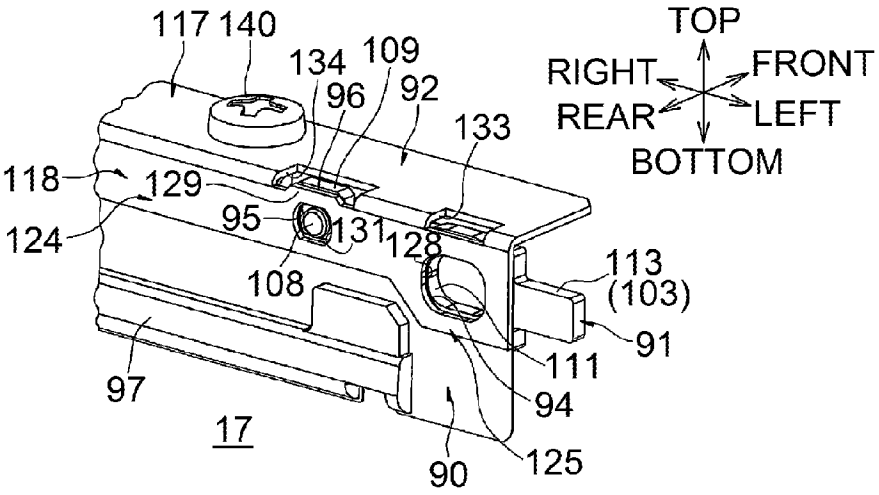
Figure 5C:
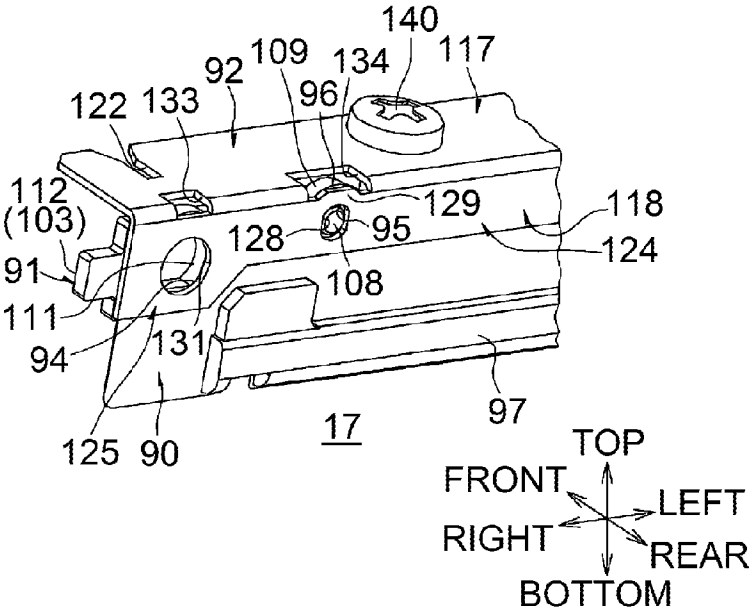

As shown in FIGS. 4A through 4C, the blade fitting portion 40 may be located at the upper-front side of the groove 42 and the upper side of the hole 41. The fitting portion 40 may define a fitting hole 55 (e.g., a hole) therein. The fitting portion 40 may form a lower surface 400, an upper surface 401, a rear surface 405, and a front surface 401. The lower surface 400, the upper surface 401, the rear surface 405, and the front surface 401 define the fitting hole 55 therein.

Figure 8A:
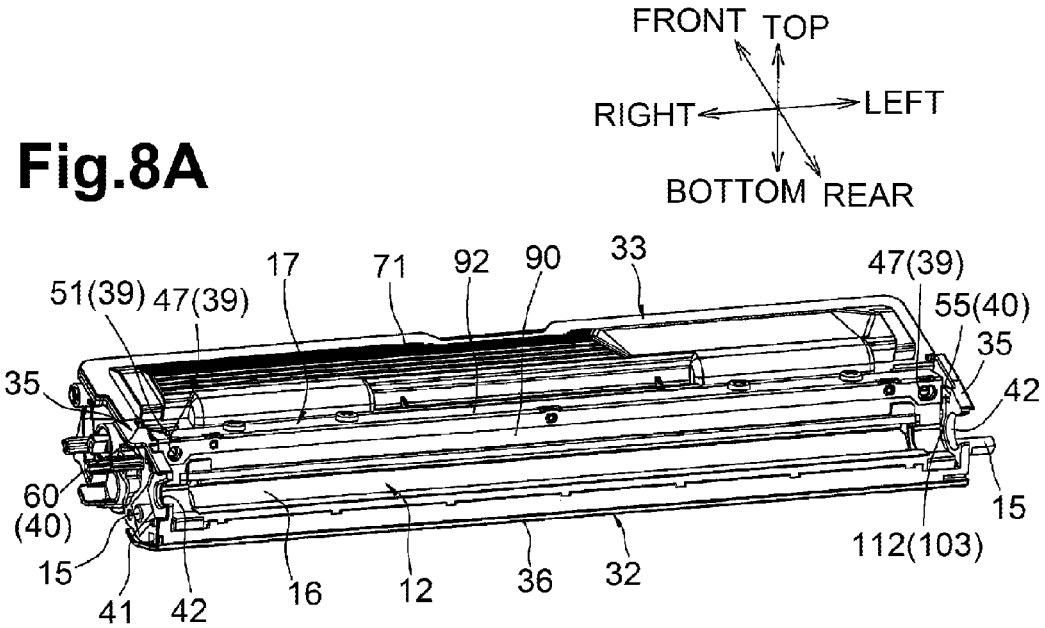
FIGS. 8A through 8B are diagrams showing a second insertion process to install the layer thickness regulating blade on the developing frame shown in FIG. 2.
Figure 8B:
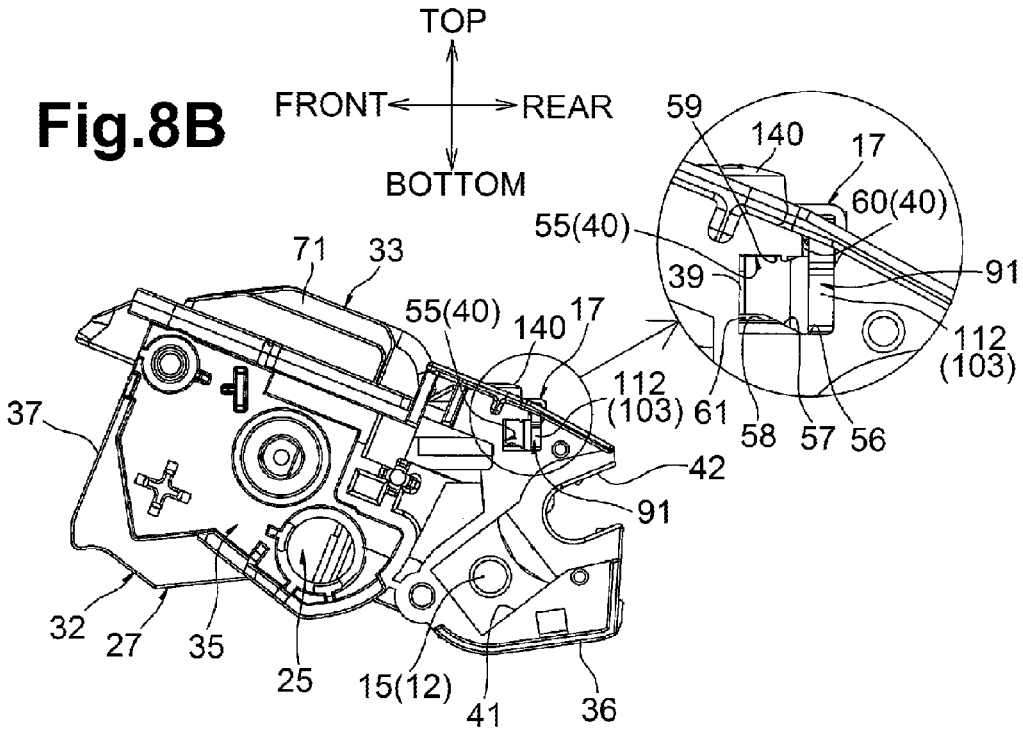

As shown in FIG. 8B, the fitting hole 55 may be a through-hole forming a substantially rectangular shape at a position slightly below the upper side of the side wall 35. As shown in FIG. 4A, the lower surface 400 of the fitting portion 40 may comprise a first lower surface 56, a second lower surface 58, an inclined surface 57, and a tip end face 610A. The first lower surface 56 may be closer to the rear surface 405 than the inclined surface 57. The second lower surface 58 may be farther away from the rear surface 405 than the inclined surface 57. The inclined surface 57 may be inclined relative to the first lower surface 56 and second lower surface 58. The inclined surface 57 may connect the first lower surface 56 and the second lower surface 58. The first lower surface 56 may extend from the lower end of the rear surface 405 in the front direction. The inclined surface 57 may be inclined toward the upper side along the front direction and may connect with the front end of the first lower surface 56 and the second lower surface 58, which may extend from the front end of the inclined surface 57 toward the front to the front surface 401. Further, a protrusion 61 (e.g., a first protrusion) may protrude from the first lower surface 56 of the lower surface 400 toward the upper surface 403. The protrusion 61 may comprise the inclined surface 57 and the second lower surface 58. Further, the protrusion 61 may comprise a rib 61A that may protrude from the second lower surface 58 toward the upper surface 403. The rib 61A may comprise the tip end face 610A. The inclined surface 57 may connect to the tip end face 610A. The rib 61A may form a substantially triangular shape that may extend upward from the second lower surface 58 toward the upper surface 59 (shown in the expanded view in FIG. 4A).

Further, as shown in FIGS. 4A through 4C, the blade fitting portion 40 of the right side wall 35 further defines a receiving groove 60. The receiving groove 60 may form an open-box-shaped shape in the planar view, in which the left side may open and depress from the left face of the right side wall 35 toward the right side, and a lower end of the receiving groove 60 may communicate with the rear portion of the fitting hole 55 of the right side wall 35.

The blade screwing portion 39 may be formed at the front side of the fitting hole 55 so as to protrude from the inner face of the side wall 35 in an inward direction. The rear face of the blade screwing portion 39 may form a flat shape that may extend along the vertical and right-left directions and may be arranged slightly rearward of the front surface 401 of the fitting portion 40. Further, the blade screwing portion 39 may define a frame screw hole 47 (e.g., a screw hole). The frame screw hole 47 may form a substantially circular shape in the rear view and may depress from the rear face of the blade screwing portion 39 in the front direction. A screw thread may be formed in the interior circumference of the blade screwing portion 39, which may define the frame screw hole 47.

Moreover, the upper surface of the blade screwing portion 39 may curve along the interior circumference of the frame screw hole 47, and a blade regulating portion 51 (e.g., a second protrusion) may be provided on the upper surface of the right side of the blade screwing portion 39. The blade regulating portion 51 may protrude upwards from the upper surface of a substantially central portion of the front portion of the blade screwing portion 39 of the right side frame 35.

As shown in FIG. 3, the lower wall 36 may form a substantially plate-shaped shape that may extend horizontally and may connect the lower ends of both side walls 35.

The front wall 37 may connect at the front end of the lower wall 36, connect at the front ends of the side walls 35, and slant to the rear along the upward direction.

The upper frame 33 may comprise a main body 71 and an upper seal holding portion 72. The main body 71 may form a substantially plate-shaped shape and may cover the upper portion of the toner storage chamber 25. The upper seal holding portion 72 may form a substantially plate-shaped shape that may extend in the rear direction and connect at the rear end of the main body 71. A length of the upper seal holding portion 72 in the right-left direction may be less than a length of the main body 71 in the right-left direction and may be substantially the same length as the length between the left and right portion of the blade fitting portion 40. The upper seal holding portion 72 may form a plurality of (e.g., four) screw accommodating portions 76.

The screw accommodating portions 76 may be separated from each other in the right-left direction. Each of the screw accommodating portions 76 may form a substantially open-box-shaped shape in planer view. A rear side of each of the screw accommodating portions 76 may open and may be depressed from the upper surface of the upper seal holding portion 72 toward the bottom.

Further, an upper seal 85 may be attached to the rear face of the upper seal holding portion 72. The upper seal 85 may be formed from elastomeric foam, such as a urethane sponge material, may extend in the right-left direction, and may form a plate-shaped shape that may be substantially rectangular in the front view. The upper seal 85 may form a plurality (e.g., four) of screw receiving portions 86.

Each of the plurality of screw receiving portions 86 may be a notch forming a substantially rectangular shape in the front view, extending from the upper surface of the upper seal 85 toward the bottom thereof, and disposed at a position overlapping the screw holding portions 76 when in a view along the right-left direction.

The upper frame 33 may be welded to both side walls 35 and the upper end of the front wall 37 in the surrounding edge of the main body 71.

Figure 6:
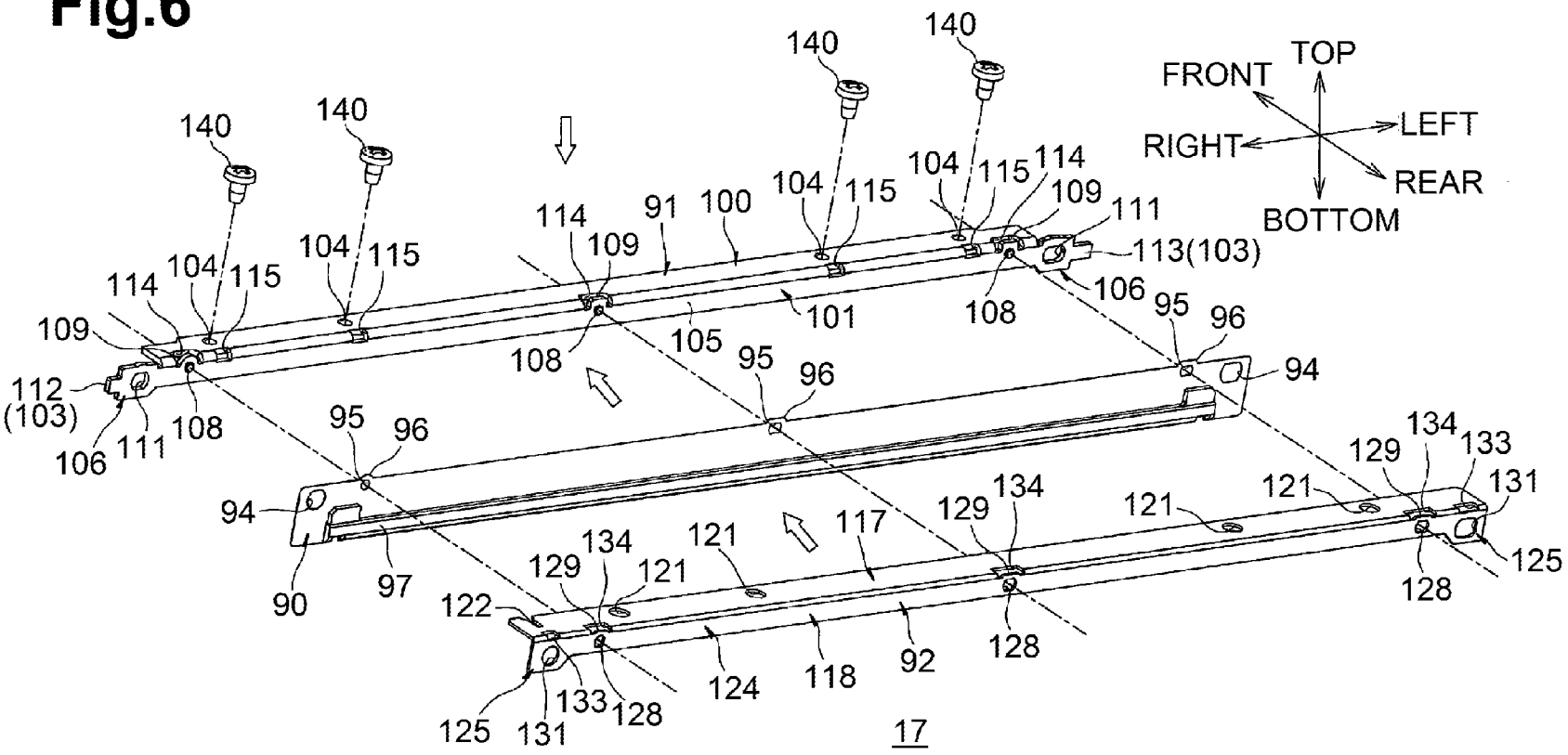
FIG. 6 is a diagram showing the assembly of the layer thickness regulating blade shown in FIG. 3.

As shown in FIG. 2, the layer thickness regulating blade 17 may be arranged to cover the entire region in the right-left direction of the rear end of the upper frame 33 (e.g., a rear face of the upper seal 85) and the rear surface of the blade screwing portion 39 of both side walls 35. As shown in FIG. 6, the layer thickness regulating blade 17 may comprise a blade member 90 (e.g., a blade member), a supporting member 91 (e.g., a first member), and a reinforcing member 92 (e.g., a second member).

The blade member 90 may be formed from a thin metal plate with elastic properties into a plate-shaped shape that may be substantially rectangular and may extend in the right-left direction in the planar view. The blade member 90 may form a plurality of (e.g., two) blade member insertion holes 94 (e.g., an insertion hole), a plurality of (e.g., three) first engaging holes 95. The blade member 90 may comprise a plurality of (e.g., three) blade protruding portions 96 and a contact portion 97.

Each of the blade member insertion holes 94 may be a through-hole formed in a front-rear direction at respective end portions in the right-left direction of the blade member 90. Further, the right blade member insertion hole 94 may be a round hole, and the left blade member insertion hole 94 may be an elongated hole extending in the right-left direction.

Each of the plurality of blade protruding portions 96 may be formed at the central portion of the blade member 90 in the right-left direction and at both horizontal end portions of the blade member 90 in the right-left direction, respectively. The plurality of blade protruding portions 96 may be closer to the center of the blade member 90 in the right-left direction than both blade member insertion holes 94. The blade protruding portion 96 may protrude from the upper surface of the blade member 90 toward the top. Further, the right blade protruding portion 96 may form a substantially semicircular shape in the front view, and center and left blade protruding portions 96 may form a substantially rectangular shape in the front view.

The first engaging hole 95 may be formed as a through-hole in the front-rear direction and disposed at the position corresponding to the plurality of blade protruding portions 96. Further, the right first engaging hole 95 may be a round hole, and the center and the left first engaging hole 95 may be an elongated hole extending in right-left direction.

The contact portion 97 may be formed of an elastomer, such as silicone rubber, may extend along the right-left direction at the rear of the lower end of the blade member 90, and may form a substantially arc-shaped shape that may protrude toward the rear in the sectional side view.

The supporting member 91 may be formed from a metal plate or another material that may be thicker than the blade member 90 and may form a substantially L-shaped shape in the sectional side view. The supporting member 91 may form a first supporting portion 100 and a second supporting portion 101.

The first supporting portion 100 may form a plate-shaped shape that may be substantially rectangular and may extend in the right-left direction in the front view. The length of the first supporting portion 100 in the right-left direction may be slightly less than a dimension of both blade screwing portions 39 in the right-left direction. The first supporting portion 100 may form a plurality (e.g., three) of first supporting notches 114, a plurality (e.g., four) of layer thickness regulating screw holes 104, and a plurality (e.g., four) of second supporting notches 115.

Each of plurality of first supporting notches 114 may be formed at a central portion of the first supporting portion 100 in the right-left direction, and both horizontal end portions of the first supporting portion 100 in the right-left direction, respectively. Each of the first supporting notches 114 may be formed as a substantially open-box-shaped notch in the planar view and may extend from the rear end of the first supporting portion 100 toward the front.

The plurality of screw holes 104 may be separated from each other in the right-left direction and may be closer in the right-left direction to the center of the first supporting portion 100 than the first supporting notches 114 at both horizontal end portions. Each of the screw holes 104 may be a through-hole forming a substantially circular shape in the planar view and a screw thread may be formed therein.

Each of the second supporting notches 115 may be disposed at a rear side of a corresponding one or more of the plurality of screw holes 104. The second supporting notch 115 may be a substantially open-box-shaped notch in the planar view and may extend from the rear end of the first supporting portion 100 toward the front.

The second supporting portion 101 may form a substantially plate-shaped shape that may be connected to the rear end of the first supporting portion 100 and that may extend toward the bottom. The second supporting portion 101 may comprise a first blade clamping portion 105 and a pair of end portions 106.

The first blade clamping portion 105 may be connected to the rear end of the first supporting portion 100. The first blade clamping portion 105 may comprise a plurality of (e.g., three) protrusions 109 and a plurality of (e.g., three) engaging protrusions 108.

Each of the plurality of protrusions 109 may be arranged to overlap the corresponding blade protruding portion 96 of the blade member 90 in a view from the front-rear direction. The protrusion 109 may be formed to protrude from the upper edge of the first blade clamping portion 105 toward the top. Further, the right side of the protrusion 109 may form a substantially semicircular shape in the front view, and the central and the left side of the protrusion 109 may form a substantially rectangular shape in the front view.

Each of the plurality of engaging protrusions 108 may be arranged to overlap the corresponding protrusion 109 of the second supporting portion 101 and the corresponding first engaging hole 95 of the blade member 90 in a view from the front-rear direction. The engaging protrusion 108 may form a substantially cylindrical shape that may protrude from the rear surface of the second supporting portion 101 toward the rear. The length in the front-rear direction of the engaging protrusion 108 may be substantially the same as a sum of the thickness in the front-rear direction of the blade member 90 and the thickness in the front-rear direction of a second reinforcing portion 118 (described below).

The pair of end portions 106 may form a substantially plate-shaped shape that may be substantially rectangular in the front view and may protrude outside along the right-left direction from both ends of the first blade clamping portion 105. The upper portion of the end portion 106 may bulge to the top more than the upper portion of the first blade clamping portion 105, and the lower portion thereof may bulge to the bottom more than the lower portion of the first blade clamping portion 105. Each of the end portions 106 may form a first insertion hole 111 (e.g., an insertion hole).

The first insertion hole 11*l* may be a through-hole defined in the front-rear direction and disposed at a substantially central portion of the end portion 106. Further, the right first insertion hole 111 may be a round hole, and the left first insertion hole 111 may be an elongated hole that may extend in the right-left direction.

Moreover, the right end portion 106 may be provided with a right protruding portion 112 (e.g., a first protruding portion), and the left end portion 106 may be provided with a left protruding portion 113 (e.g., a second protruding portion).

The right protruding portion 112 may protrude toward the right from a substantially central portion of the right end of the right end portion 106 in the vertical direction. The right protruding portion 112 may form a plate-shaped shape that may be substantially rectangular in the front view.

The left protruding portion 113 may protrude toward the left from a substantially central portion of the left end of the left side of the end portion 106 in the vertical direction. The left protruding portion 113 may form a plate-shaped shape that may be substantially rectangular in the front view. The length in the right-left direction of the left protruding portion 113 may be greater than the length in the right-left direction of the right protruding portion 112. The right protruding portion 112 and the left protruding portion 113 may be configured to function as a positioning member 103.

Similar to the supporting member 91, the reinforcing member 92 may be formed from a metal plate or another material that may be thicker than the blade member 90 and may form a substantially L-shaped shape in the sectional side view. The reinforcing member 92 may comprise a first reinforcing portion 117 and a second reinforcing portion 118. The first reinforcing portion 117 may form a plate-shaped shape that may be substantially rectangular in the front view that may extend in the right-left direction. The length in the right-left direction of the first reinforcing portion 117 may be greater than the distance between blade screwing portions 39 and may be less than the distance between side walls 35. The first reinforcing portion 117 may form a plurality of (e.g., two) first notches 133, a plurality of (e.g., three) second notches 134, a plurality of (e.g., four) insertion holes 121, and a third notch 122 (e.g., a notch).

The plurality of first notches 133 may be formed on both right-left end portions of the first reinforcing portion 117. The first notch 133 may be a substantially open-box-shaped notch in the planar view that may extend from the rear end of the first reinforcing portion 117 toward the front.

Each of the plurality of second notches 134 may be formed at a central portion of the first reinforcing portion 117 in the right-left direction and both end portions in the right-left direction of the first reinforcing portion 117, respectively. Each of the plurality of second notches 134 may be closer to the center of the first reinforcing portion 117 in the right-left direction than the each of the first notches 133. The second notch 134 may be formed as a substantially open-box-shaped notch in the planar view that may extend from the rear end of the first reinforcing portion 117 toward the front.

The plurality of insertion holes 121 may be separated from each other in the right-left direction. Each of the plurality of insertion holes 121 may be closer to the center of the first reinforcing portion 117 in the right-left direction than each of the second notches 134 at both end portions of the first reinforcing portion 117. Each of the insertion holes 121 may be a through-hole that may form a substantially circular shape in the planar view.

The third notch 122 may be formed to the rear of the first notch 133 at the right end portion of the first reinforcing portion 117. The third notch 122 may be shaped as a substantially straight-line notch that may extend from the front portion of the first reinforcing portion 117 in the rear direction.

The second reinforcing portion 118 may form a substantially plate-shaped shape that may extend toward the bottom and may connect with the rear end of the first reinforcing portion 117. The second reinforcing portion 118 may comprise a second blade clamping portion 124 and a pair of reinforcing member bulging portions 125.

The length of the second blade clamping portion in the right-left direction 124 may be less than the distance between of the first notches 133. The second blade clamping portion 124 may comprise a plurality of (e.g., three) reinforcing protruding portions 129. Further, the second blade clamping portion 124 may form a plurality of (e.g., three) second engaging holes 128 (e.g., an engaging hole).

Each of the reinforcing protruding portions 129 may be arranged to overlap the corresponding blade protruding portion 96 of the blade member 90 and the corresponding protrusion 109 of the supporting member 91 in the front-rear direction. Each of the reinforcing protruding portions 129 may protrude from the upper edge of the second blade clamping portion 124 toward the top. Further, the right reinforcing protruding portion 129 may form a substantially trapezoidal shape in the front view in which both horizontal sides slant to the horizontal interior side toward the upper side. The central reinforcing protruding portion 129 and the left reinforcing protruding portion 129 may form a substantially trapezoidal shape from the front view in which the length in the right-left direction may be greater than the length in the right-left direction of the right reinforcing protruding portion 129.

Each of the plurality of second engaging holes 128 may be disposed to overlap the corresponding reinforcing protruding portion 129 of the second reinforcing portion 118, the corresponding first engaging holes 95 in the blade member 90, and the plurality of engaging protrusions 108 of the supporting member 91 in the longitudinal direction. The second engaging hole 128 may be a through-hole defined in the longitudinal direction. Further, the right second engaging hole 128 may be a round hole, and each of the central second engaging hole 128 and the left second engaging hole 128 may be an elongated hole that may extend in the horizontal direction.

Each of the pair of reinforcing member bulging portions 125 may be disposed at one or more of the ends of the second reinforcing portion 118 in the right-left direction, respectively, and may form a plate-shaped shape that may be substantially rectangular in the front view and may be longer than the bottom of the second blade clamping portion 124. The reinforcing member bulging portion 125 may be a second insertion hole 131 (e.g., an insertion hole).

The second insertion hole 131 may be a through-hole defined in the front-rear direction and may be disposed at a substantially central portion of the reinforcing member bulging portion 125. Further, the right second insertion hole 131 may be a round hole, and the left second insertion hole 131 may be an elongated hole that may extend in the horizontal direction.

A process of assembling the developing cartridge 7 now is described.

An initial step in assembling the developing cartridge 7 may be assembling the layer thickness regulating blade 17. An initial step in assembling the layer thickness regulating blade 17 may be to install the blade member 90 on the supporting member 91 from the rear side. Specifically, the engaging protrusion 108 on the supporting member 91 may be inserted into the first engaging hole 95 in the blade member 90.

Subsequently, the reinforcing member 92 may be installed on the supporting member 91 and the blade member 90 from the rear side. Specifically, the engaging protrusion 108 on the blade member 90 may be inserted into the second engaging hole 128 in the reinforcing member 92 via the first engaging hole 95 in the blade member 90.

Consequently, the blade member 90 may be clamped in the front-rear direction by the first blade clamping portion 105 of the supporting member 91 and the second blade clamping portion 124 of the reinforcing member 92, and, at the same time, the layer thickness regulating screwing hole 104 in the supporting member 91 and the layer thickness regulating screw insertion hole 121 in the reinforcing member 92 may line up in the vertical direction.

In this state, a screw 140 may be screwed through the layer thickness regulating screw insertion hole 121 into the layer thickness regulating screwing hole 104 from above.

As shown in FIGS. 5A through 5D, the blade member 90 may be secured by screws when the blade member 90 is clamped by the supporting member 91 and the reinforcing member 92.

Consequently, this may complete the assembly of the layer thickness regulating blade 17.

At this time, the blade member insertion hole 94 of the blade member 90, the first insertion hole 111 of the supporting member 91, and the second insertion hole 131 of the reinforcing member 92 may all line up in the front-rear direction. Further, the blade protruding portion 96 of the blade member 90 and the protrusion 109 of the supporting member 91 may be exposed from the second notch 134 of the reinforcing member 92.

Thereafter, as shown in FIGS. 7A through 7B, 8A through 8B, and 9A through 9C, the layer thickness regulating blade 17 may be installed to the developing frame 27.

Figures 7A, 7B:
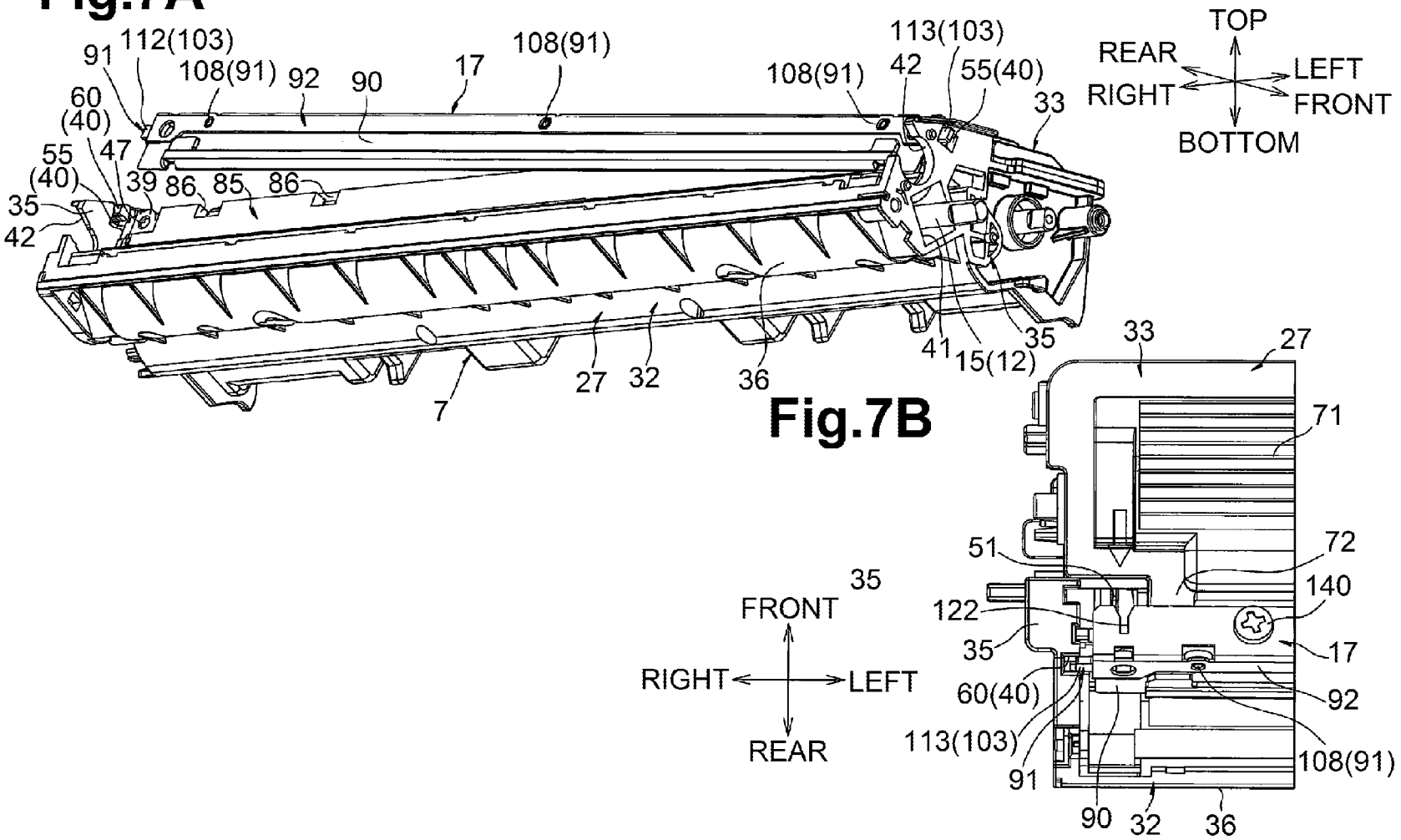
FIGS. 7A through 7B are diagrams showing a first insertion process to install the layer thickness regulating blade on the developing frame shown in FIG. 2.

As shown in FIGS. 7A through 7B, the layer thickness regulating blade 17 may be installed to the developing frame 27 by slanting the left end of the layer thickness regulating blade 17 to the lower-left and inserting the left end of the layer thickness regulating blade 17 into the fitting hole 55 in the side wall 35 on the left side in a direction from the right side to the left side, such that the left protruding portion 113 may be supported above the first lower surface 56 (e.g., a first insertion process).

Subsequently, the right end of the layer thickness regulating blade 17 may be swung to the bottom using the contacting portions of the left protruding portion 113 and the first lower surface 56 as a fulcrum. As shown in FIGS. 8A through 8B, the right protruding portion 112 of the layer thickness regulating blade 17 may be inserted into the right fitting hole 55 via the right receiving groove 60 of the right side walls 35 and may be supported above the first lower surface 56 (e.g., a second insertion process).

Thereafter, the horizontal position of the layer thickness regulating blade 17 may be adjusted so that the blade regulating portion 51 of the developing frame 27 and the third notch 122 of the layer thickness regulating blade 17 may line up in the front-rear direction, and the layer thickness regulating blade 17 may be pushed toward the front of the developing frame 27. As shown in FIG. 9B, this may enable the right protruding portion 112 and the left protruding portion 113 of the layer thickness regulating blade 17 to slide from the first lower surface 56 along the inclined surface 57 of the fitting hole 55 toward the top, such that the right protruding portion 112 and the left protruding portion 113 may be directed to the second lower surface 58. Further, by pushing the layer thickness regulating blade 17 to the front, the right protruding portion 112 and the left protruding portion 113 may be biased toward the upper surface 59 of the fitting hole 55 by removing the upper portion of the protrusion 61 formed on the second lower surface 58 (e.g., positioning process). In this manner, each of the right protruding portion 112 and the left protruding portion 113 may contact the respective upper surface 59 of the fitting hole 55 and the protrusion 61.

At this time, the lower end of the screw 140 screwed into the layer thickness regulating blade 17 may be contained in the screw compartment portion 76 of the upper frame 33 through the screw receiving portion 86 in the upper seal 85.

Figure 9A:
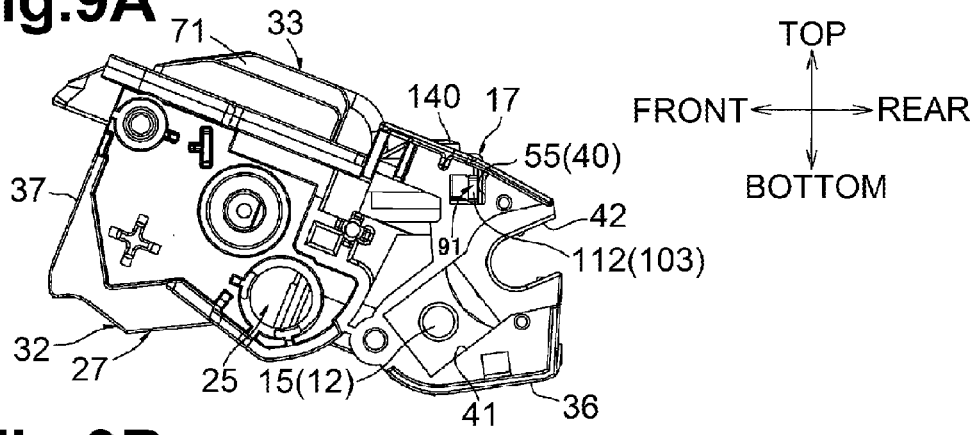
FIGS. 9A through 9C are diagrams showing a positioning process to install the layer thickness regulating blade on the developing frame shown in FIG. 2.
Figure 9B:
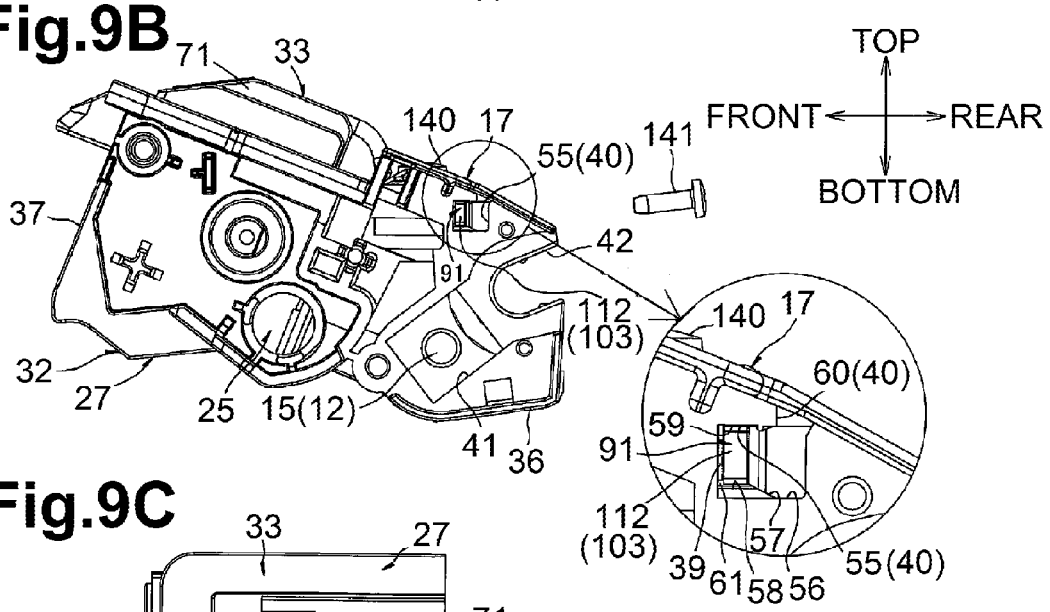
Figure 9C:
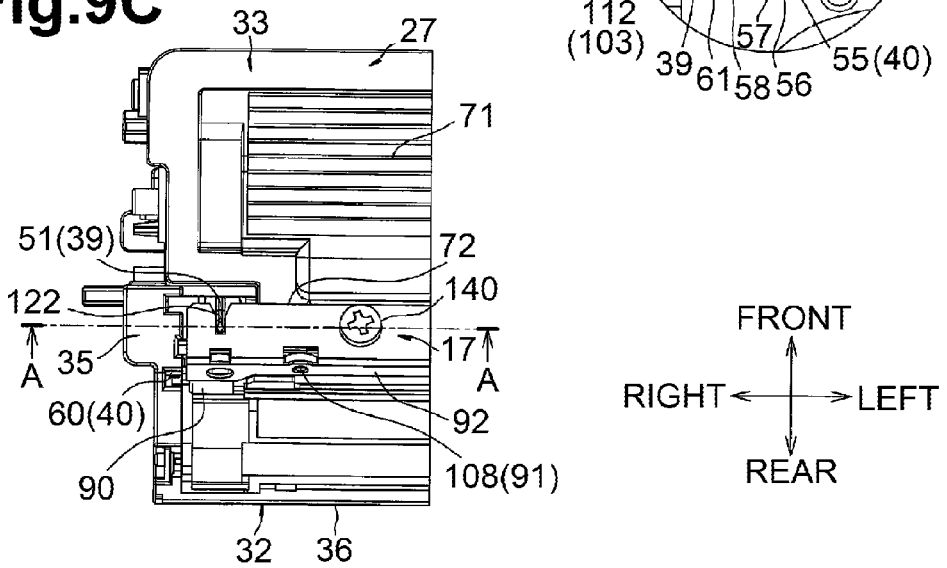
Figure 10:
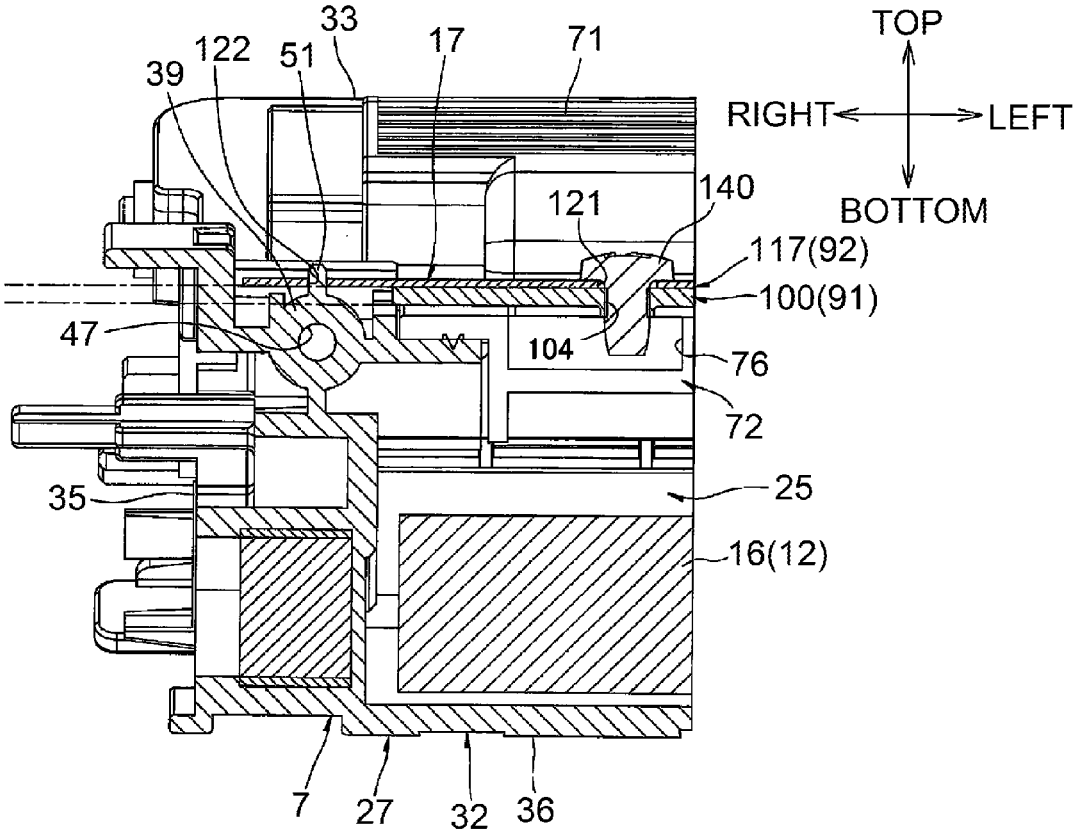
FIG. 10 is a cross-sectional diagram taken along the line A-A in FIG. 9C showing the developing frame.

As shown in FIG. 9C, this may result in the blade regulating portion 51 being arranged in the third notch 122. Specifically, as shown in FIG. 10, when the blade regulating portion 51 is disposed in the third notch 122, the upper edge of the blade screwing portion 39 may be disposed closer to the top than the upper surface of the first supporting portion 100, and the length in the right-left direction of the first supporting portion 100 of the supporting member 91 may be less than the distance between blade screwing portions 39. Consequently, the size of the layer thickness regulating blade 17 may be reduced in the vertical direction.

Thus, as shown in FIGS. 9A through 9C, when the layer thickness regulating blade 17 is pushed into the developing frame 27, a screw 141 may be inserted into the frame screw hole 47 through the first insertion hole 111, blade member insertion hole 94, and the second insertion hole 131. Consequently, the front surface of the end portion 106 in the supporting member 91 of the layer thickness regulating blade 17 may abut the rear surface of the blade screwing portions 39 in the developing frame 27.

The processes described above may complete the installation of the layer thickness regulating blade 17 to the developing frame 27. Accordingly, each of the right protruding portion 112 and the left protruding portion 113 may be fixed in contact the respective upper surface 59 of the fitting hole 55 and the protrusion 61.

Further, according to the configurations described above, when the layer thickness regulating blade 17 is pushed toward the front, although the right protruding portion 112 and the left protruding portion 113 may be biased toward the upper surface 59 of the fitting hole 55 by removing the upper portion of the protrusion 61 formed on the second lower surface 58, this removal is not necessarily required. For example, a member that elastically deforms, such as a rubber member, may be alternatively provided in place of the protrusion 61, in such that the right protruding portion 112 and the left protruding portion 113 may be biased toward the upper surface 59 of the fitting hole 55 by the protrusion without requiring removal of the protrusion.

As shown in FIG. 2, the developing roller 11 may be installed on the developing frame 27. To install the developing roller 11 on the developing frame 27, both end portions of the developing roller shaft 13 may be rotatably supported in the groove 42 of the side walls 35. Consequently, the rubber roller 14 of the developing roller 11 may make opposing contact with the end portion of the contact portion 97 of the blade member 90. This may complete the installation of the developing roller 11 on the developing frame 27.

As described above, this may complete the assembly of the developing cartridge 7.

(1) As shown in FIGS. 9A through 9C, the developing cartridge 7 described herein may enable the layer thickness regulating blade 17 to be positioned in the vertical direction (e.g., the second direction) by the positioning member 103 being biased toward the upper surface 59 by the protrusion 61 provided on second lower surface 58 of the fitting hole 55 of the side wall 35. Thus, the layer thickness regulating blade 17 may be vertically disposed by providing installation holes at the layer thickness regulating blade 17 rather than by providing a boss with a diameter greater than a diameter of the frame screw hole 47 of the side wall 35. By forming the fitting hole 55 penetrating the side wall 35 in the right-left direction and provisioning the protrusion 61 in this fitting hole 55 to bias toward the upper surface 59 of the fitting hole 55, the layer thickness regulating blade 17 may be vertically disposed. Consequently, the size of the layer thickness regulating blade 17 may be reduced along the vertical direction, which may enable the size of the developing cartridge 7 to be reduced.

(2) Further, as shown in FIGS. 5A through 5D, the developing cartridge 7 described herein may enable the right protruding portion 112 and the left protruding portion 113, each with different horizontal lengths, to be provided on both end portions of the layer thickness regulating blade 17 in the right-left direction. As shown in FIGS. 7A through 7B, this may enable the left protruding portion 113, which may extend over a relatively great length in the right-left direction, to first be installed into the fitting hole 55 in the blade fitting portion 40 of the developing frame 27. At this time, the left protruding portion 113 may be securely supported in the developing frame 27 by insertion into the fitting hole 55, and, subsequently, the right protruding portion 112, which may extend over a relatively short length in the right-left direction, may be securely installed into the fitting hole 55 through the receiving groove 60. Consequently, the right protruding portion 112 and the left protruding portion 113 of the layer thickness regulating blade 17 may be efficiently and securely installed into the fitting holes 55 of the developing frame 27.

(3) Further, as shown in FIGS. 9A through 9C, the developing cartridge 7 described herein may enable the layer thickness regulating blade 17 to be disposed in the right-left direction by engaging the third notch 122 of the layer thickness regulating blade 17 along the front-rear direction with the blade regulating portion 51 that may extend upwards from the right side of the side wall 35. Thus, the vertical positioning and the right-left positioning of the layer thickness regulating blade 17 may be in different places. Consequently, the size of the developing cartridge 7 may be reduced, and freedom of design may be improved.

(4) Further, as shown in FIG. 2, the developing cartridge 7 described herein may enable the layer thickness regulating blade 17 to be installed on the developing frame 27 by the securing of the screw 141. Moreover, as shown in FIG. 10, the blade regulating portion 51 may be provided with the frame screw hole 47 on an upper side thereof where the screw 141 may be secured, and the third notch 122 of the layer thickness regulating blade 17 biased toward the top may be securely engaged to the blade regulating portion 51 therewith. Thus, the layer thickness regulating blade 17 may be positioned in the right-left direction in a secure manner.

(5) Further, as shown in FIGS. 9A through 9C, the developing cartridge 7 described herein may enable the rear surface of the blade screwing portions 39 and the front surface of the end portion 106 to make contact so that the front-rear direction of the layer thickness regulating blade 17 may be positioned by securing the screw 141 to the frame screw holes 47 of the pair of side walls 35 through the layer thickness regulating blade 17. Thus, the vertical positioning, the right-left positioning, and the front-rear positioning of the layer thickness regulating blade 17 may be at different places from each other. Consequently, the size of the developing cartridge 7 may be reduced, and freedom of design may be improved.

(6) Further, as shown in FIG. 6 and regarding the supporting member 91 and the reinforcing member 92 of the layer thickness regulating blade 17, the developing cartridge 7 described herein may enable the vertical length of the central portion in the right-left direction to be less than the vertical length of both end portions. Thus, a space in which the insertions holes (e.g., the first insertion hole 111 and the second insertion hole 131) may be provisioned for securing both horizontal ends of the layer thickness regulating blade 17, and the size of the layer thickness regulating blade 17 may be reduced. Consequently, the layer thickness regulating blade 17 may be securely fixed on the developing frame 27 by the screw 141, and the size of the developing cartridge 7 may be reduced.

(7) Further, as shown in FIGS. 5A through 5D, the developing cartridge 7 described herein may enhance the reliability of the strength of the layer thickness regulating blade 17 by engaging the blade member 90 with the supporting member 91 and the reinforcing member 92. Moreover, the positioning member 103 (e.g., the right protruding portion 112 and the left protruding portion 113) and the third notch 122 may each be formed with different members, which may allow for the size of the layer thickness regulating blade 17 to be less than that when the positioning member 103 (e.g., the right protruding portion 112 and the left protruding portion 113) and the third notch 122 are formed onto both the supporting member 91 and the reinforcing member 92. Thus, the strength of the layer thickness regulating blade 17 may be reliably maintained, and the size of the developing cartridge 7 may be reduced.

(8) Further, as shown in FIG. 6, the developing cartridge 7 described herein may regulate the right-left movement of the supporting member 91 and the reinforcing member 92 by engaging the engaging protrusion 108 to the second engaging hole 128. Thus, the relative displacement in the right-left direction of the supporting member 91 and the reinforcing member 92 may be regulated by a simple configuration.

(9) As shown in FIGS. 5A through 5D, the method of manufacturing the developing cartridge 7 described herein may enable the right protruding portion 112 and the left protruding portion 113, which may extend for different respective lengths in the right-left direction, to be provided on both horizontal ends of the layer thickness regulating blade 17. Thus, as shown in FIGS. 7A through 7B, the left protruding portion 113, which may extend over a relatively great length in the right-left direction, may be installed to the fitting hole 55 in the developing frame 27 initially. Thereafter, the left protruding portion 113 may be securely supported to the developing frame 27 by inserting the left protruding portion 113 into the fitting hole 55. Subsequently, the right protruding portion 112, which may extend over a relatively short length in the right-left direction, may be securely installed to the fitting hole 55 via the receiving groove 60. Further, as shown in FIGS. 9A through 9C, when the right protruding portion 112 and the left protruding portion 113 is installed in the fitting hole 55, the layer thickness regulating blade 17 may be pushed toward the front, which may enable the protrusion 61 provided in the fitting hole 55 to bias the right protruding portion 112 and the left protruding portion 113 toward the upper surface 59 of the fitting hole 55. Consequently, the layer thickness regulating blade 17 may be vertically positioned. Consequently, the right protruding portion 112 and the left protruding portion 113 may be efficiently and securely installed to the fitting hole 55, and the layer thickness regulating blade 17 may be vertically positioned.

Further, installation holes may be provided in the layer thickness regulating blade 17 to vertically position the layer thickness regulating blade 17, instead of provisioning a boss with a diameter greater than a diameter of the frame screw hole 47 in the side wall 35. By forming the fitting hole 55 penetrating the side wall 35 in the right-left direction and provisioning the protrusion 61 in this fitting hole 55 to bias the right protruding portion 112 and the left protruding portion 113 of the layer thickness regulating blade 17 toward the upper surface 59 of the fitting hole 55, the layer thickness regulating blade 17 may be vertically positioned. Therefore, the size of the layer thickness regulating blade 17 may be reduced in the vertical direction, which may enable the size of the developing cartridge 7 to be reduced.

While the invention has been described in connection with various exemplary structures and illustrative configurations, it will be understood by those skilled in the art that other variations and modifications of the structures, configurations, and embodiments disclosed above may be made without departing from the scope of the invention. For example, this application comprises each and every possible combination of the various elements and features disclosed and incorporated by reference herein, and the particular elements and features presented in the claims and disclosed and incorporated by reference above may be combined with each other in each and every possible way within the scope of the application, such that the application should be recognized as also directed to other embodiments comprising other possible combinations. Other structures, configurations, and embodiments consistent with the scope of the claimed invention will be apparent to those skilled in the art from a consideration of the specification or practice of the invention disclosed herein. It is intended that the specification and the described examples are illustrative with the true scope of the invention being defined by the following claims.

What is claimed is:

1. A developing cartridge comprising:

a frame including:

a first side wall; and a second side wall separated from the first side wall in a first direction, wherein the first wall has a first cavity defined by at least:
a first surface; and
a second surface opposing the first surface, the second surface being spaced apart from the first surface;
a developing roller extending in the first direction;
a developer thickness regulating blade extending in the first direction, the developer thickness regulating blade configured to regulate a thickness of developer on the developing roller, the developer thickness regulating blade positioned between the first side wall and the second side wall in the first direction, and the developer thickness regulating blade having a first end portion and a second end portion separated from the first end portion in the first direction, the developer thickness regulating blade including:
a first protrusion protruding in the first direction, the first protrusion being positioned at the first end portion, the first protrusion is positioned between the first surface and the second surface; and
a second protrusion protruding from the first surface toward the second surface,
wherein the first protrusion is positioned between the second protrusion and the second surface;
a first inclined surface being inclined relative to the first surface, the first inclined surface extends from the first surface toward the second protrusion; and
a first intermediate surface extending from the first inclined surface to the second protrusion, the first intermediate surface disposed closer than the first inclined surface to the second surface.

2. The developing cartridge according to claim 1,
wherein the first protrusion is fixed between the second protrusion and the second surface.

3. The developing cartridge according to claim 1,
wherein the first protrusion is in contact with both the second protrusion and the second surface.

4. The developing cartridge according to claim 1,
wherein the first cavity is a through hole through the first side wall in the first direction.

5. The developing cartridge according to claim 1,
wherein the first cavity is further defined by a third surface extending from the first surface to the second surface, and
wherein the second protrusion extends from the first surface to the third surface.

6. The developing cartridge according to claim 1, further comprising:
a first inclined surface being inclined relative to the first surface, the first inclined surface extends from the first surface toward the second protrusion.

7. The developing cartridge according to claim 1,
wherein the developer thickness regulating blade including:
a blade part extending in the first direction; and
a supporting member extending in the first direction, the supporting member includes the first end portion and the second end portion;
wherein the first protrusion is positioned at the first end portion.

8. The developing cartridge according to claim 7,
wherein the first protrusion protrudes from the first end portion.

9. The developing cartridge according to claim 8,
wherein the length of the supporting member in the first direction is greater than a length of the blade part in the first direction.

10. The developing cartridge according to claim 1,
wherein the developer thickness regulating blade further includes:
a third protrusion protruding in the first direction, the third protrusion being positioned at the second end portion;
wherein the second wall has a second cavity, the second cavity defined by at least:
a first surface;
a second surface opposing the first surface of the second cavity, the second surface of the second cavity being spaced apart from the first surface of the second cavity;
wherein the third protrusion is positioned between the first surface of the second cavity and the second surface of the second cavity.

11. The developing cartridge according to claim 10,
wherein the developing cartridge further includes:
a fourth protrusion protruding from the first surface of the second cavity toward the second surface of the second cavity, and
wherein the third protrusion is positioned between the fourth protrusion and the second surface of the second cavity.

12. The developing cartridge according to claim 11,
wherein the third protrusion is fixed between the fourth protrusion and the second surface of the second cavity.

13. The developing cartridge according to claim 11,
wherein the third protrusion is in contact with both the fourth protrusion and the second surface of the second cavity.

14. The developing cartridge according to claim 11,
wherein the second cavity is a through hole through the second side wall in the first direction.

15. The developing cartridge according to claim 11,
wherein the first cavity is further defined by a third surface of the second cavity, the third surface of the second cavity extending from the first surface of the second cavity to the second surface of the second cavity, and
wherein the fourth protrusion extends from the first surface of the second cavity to the third surface of the second cavity.

16. The developing cartridge according to claim 11, further comprising:
a second inclined surface that is inclined relative to the first surface, the second inclined surface extends from the first surface of the second cavity toward the second surface of the second cavity.

17. A developing cartridge comprising:
a frame including:
a first side wall; and
a second side wall separated from the first side wall in a first direction,
wherein the first wall has a first cavity defined by at least:
a first surface; and
a second surface opposing the first surface, the second surface being spaced apart from the first surface,
wherein the second wall has a second cavity, the second cavity defined by at least:
a first surface;
a second surface opposing the first surface of the second cavity, the second surface of the second cavity being spaced apart from the first surface of the second cavity;
a developing roller extending in the first direction;
a developer thickness regulating blade extending in the first direction, the developer thickness regulating blade configured to regulate a thickness of developer on the developing roller, the developer thickness regulating blade positioned between the first side wall and the second side wall in the first direction, and the developer thickness regulating blade having a first end portion and a second end portion separated from the first end portion in the first direction, the developer thickness regulating blade including:

a first protrusion protruding in the first direction, the first protrusion being positioned at the first end portion, the first protrusion is positioned between the first surface and the second surface;

a third protrusion protruding in the first direction, the third protrusion being positioned at the second end portion; and a fourth protrusion protruding from the first surface of the second cavity toward the second surface of the second cavity;

a second inclined surface being inclined relative to the first surface of the second cavity, the second inclined surface extends from the first surface of the second cavity toward the fourth protrusion; and a second intermediate surface extending from the second inclined surface to the fourth protrusion, the second intermediate surface disposed closer than the second inclined surface to the second surface of the second cavity, wherein the third protrusion is positioned between the first surface of the second cavity and the second surface of the second cavity, and wherein the third protrusion is positioned between the fourth protrusion and the second surface of the second cavity.

18. The developing cartridge according to claim 11, wherein the developer thickness regulating blade including:

a blade part extending in the first direction; and a supporting member extending in the first direction, the supporting member includes the first end portion and the second end portion;

wherein the first protrusion is positioned at the first end portion, and wherein the third protrusion is positioned at the second end portion.

19. The developing cartridge according to claim 18, wherein the first protrusion protrudes from the first end portion, and wherein the third protrusion protrudes from the second end portion.

20. The developing cartridge according to claim 19, wherein the length of the supporting member in the first direction is greater than a length of the blade part in the first direction.

21. The developing cartridge according to claim 11, wherein the developer thickness regulating blade has a notch, and wherein the frame comprises a fifth protrusion protruding from the frame, the fifth protrusion fitting in the notch.

22. The developing cartridge according to claim 21, wherein the notch is disposed closer to the first end portion than the second end portion.

23. The developing cartridge according to claim 1, a supply roller configured to supply developer to the developing roller, the supply roller including a supply roller shaft extending in the first direction, wherein the second surface is disposed further from the supply roller shaft than the first surface.

24. The developing cartridge according to claim 11, a supply roller configured to supply developer to the developing roller, the supply roller including a supply roller shaft extending in the first direction, wherein the second surface of the second cavity is disposed further from the supply roller shaft than the first surface of the second cavity.

* * * * *